United States Patent [19]

Helm

[11] Patent Number: 4,901,479

[45] Date of Patent: Feb. 20, 1990

[54] PORTABLE HAND MACHINE TOOL, PARTICULARLY ANGLE GRINGER

[75] Inventor: Winfried Helm, Leinfelden, Fed. Rep. of Germany

[73] Assignee: Robert Bosch GmbH, Stuttgart, Fed. Rep. of Germany

[21] Appl. No.: 343,143

[22] Filed: Nov. 28, 1989

[86] PCT No.: PCT/DE87/00551

§ 371 Date Apr. 14, 1989

§ 102 Date Apr. 14, 1989

[87] PCT Pub.: WO88/04219

PCT Pub. Date.: Jun. 16, 1988

[30] Foreign Application Priority Data

Dec. 10, 1986 [DE] Fed. Rep. of Germany ..... 3642153

[51] Int. Cl.[4] ..... B24B 23/02

[52] U.S. Cl. ..... 51/170 R; 51/168; 83/666; 279/97

[58] Field of Search ..... 51/168, 170 R, 170 PT, 51/170 T; 83/666, 698; 279/1 K, 1 R, 8, 97

[56] References Cited

U.S. PATENT DOCUMENTS 2,667,687 2/1954 Clarkson ..... 279/97

OTHER PUBLICATIONS

Europaeische Patentanmeldung 0 152 564/Werkzeugbefestigung.

*Primary Examiner*—Roscoe V. Parker
*Attorney, Agent, or Firm*—Michael J. Striker

[57] ABSTRACT

An angle grinder comprising a hollow drive shaft with a counterflange mounted at an end thereof, a spindle extending through the drive shaft and coupled thereto for joint rotation therewith and an axial displacement relative thereto and having a threaded end portion for receiving thereon a clamp nut cooperating with the counterflange for clamping a grinding wheel therebetween, and a slidable wedge extending transversely through the drive shaft and the spindle and having an inclined surface displaceable along respective inclined surfaces of the drive shaft and the spindle to provide for axial displacement of the spindle relative to the drive shaft.

13 Claims, 2 Drawing Sheets

PORTABLE HAND MACHINE TOOL, PARTICULARLY ANGLE GRINGER

BACKGROUND OF THE INVENTION

The invention relates to a portable hand machine tool, particularly an angle grinder. A portable hand machine tool is known (EP-OS No. 152,564) in which a slide element is supported for transverse sliding along guide means in the housing and has an inclined surface acting on an axial flange surface of the spindle during the transverse sliding. The spindle is then slid axially relative to the drive shaft together with a screwed-on spindle nut so far that an axial slackening of the clamp nut then occurs, whereupon the clamp nut can be unscrewed fully by hand without the need for additional tools. It is thereby intended to permit an exchange of a tool, a grinding wheel of an angle grinder for example, without use of an additional tool so that the exchange can be effected rapidly and simply by hand. In this hand machine tool, an axial spring is inserted between the spindle and the drive shaft. The spring forces the spindle in the opposite direction into an initial position defined by an axial stop when the slide element is inoperative. When clamping a tool, in particular a grinding wheel, by screwing on and tightening the clamp nut, the grinding wheel becomes clamped between the clamp nut and the counterflange as a part of the drive shaft braced axially against the latter. An axial traction force then acts upon the spindle, and has to be braced by the drive shaft through the spring. As is known, the clamp nut tightens further spontaneously during the operation of the hand machine tool. It is therefore necessary for the spring to have an extraordinary rigidity in order to ensure this tightening and the firm seat of the clamp tool with certainty. If the spindle is to be slid axially relative to the drive shaft for slackening without using an additional tool and release of the clamp nut, by a transverse sliding of the slide element, then it is necessary for the inclined surface of the latter to exert an additional axial force which enables the slackening by compressing the axial spring. Sliding of the slide element, therefore, requires application of a considerable force, which makes the manipulation considerably more difficult and can generally actually be applied only with the assistance of additional auxiliary tools. It is also necessary for the operator to ensure that after a tool change, the slide element is first of all slid back into a "closed" position and its inclined surface therefore moves out of engagement with the spindle before the drive motor is switched on. If this is neglected and the drive motor is switched on while the inclined surface is still in engagement with the spindle, there is a danger of the motor being damaged and/or the inclined surface and the axial surface of the spindle, which it stresses, being ground away and damaged. The manipulation of the fastening device, particularly of the slide element, therefore demands particular attention by the operator. No automatic, possibly spring elastic, return possibility for the slide element is available here.

SUMMARY OF THE INVENTION

The object of the invention is to provide a portable hand machine tool, particularly an angle grinder in which tool exchange without using an additional tool is possible without danger of damaging the motor and/or mutually engaged surfaces of the slider and the spindle.

The object of the invention is achieved by forming the slide element as a wedge coupled to the drive shaft and the spindle for joint rotation therewith. Because the wedge is coupled to the drive shaft and to the spindle and rotates in common with both, and hence the inclined surface of the wedge on the one hand and the wedge surfaces of both parts cooperating with the latter on the other hand rotate in common, the problem of possible incorrect operation with damage to the motor and to said mutually engaged surfaces does not arise. The wedge constitutes a torque-transmitting coupling between drive shaft and spindle, so that no further shaped surfaces are necessary for a positive engagement with torque transmission between the two. This reduces the outlay and costs for it. Because the wedge is located between drive shaft and spindle, coupling the two, it can be slid, in order to slide the spindle with screwed-on clamp nut in the release direction, relatively fast and simply and be exerting only a weak force in the direction of the inclined surface and the wedge surface acting with the latter. No particular and major exertion of force is required for this purpose. The hand machine tool permits an exchange of grinding wheels without any auxiliary tool, which can moreover be performed fast and reliably. It is also advantageous that already existing hand machine tools of the generic type can also be modified to include the features according to the invention. Despite all this, the hand machine tool is simple and inexpensive. Parts already used hitherto, standardized in some cases, are still used as far as possible, the standardized clamp nut in particular. In particularly obstinate cases, where the clamp nut has rusted, for example, it can therefore still be released by means of a suitable additional spanner. According to a further development of the present invention, a spindle locking device, which is already present in differently shaped known hand machine tools, is utilized simultaneously to slide the wedge in the "slacken" direction and therefore put to a double use without the need for a special additional part for this purpose.

The invention as to its construction so to its mode of operation, will be best understood from the following detailed description of the preferred embodiment with reference to the appended drawings.

DESCRIPTION OF THE PREFERRED EMBODIMENT

Figure 1:
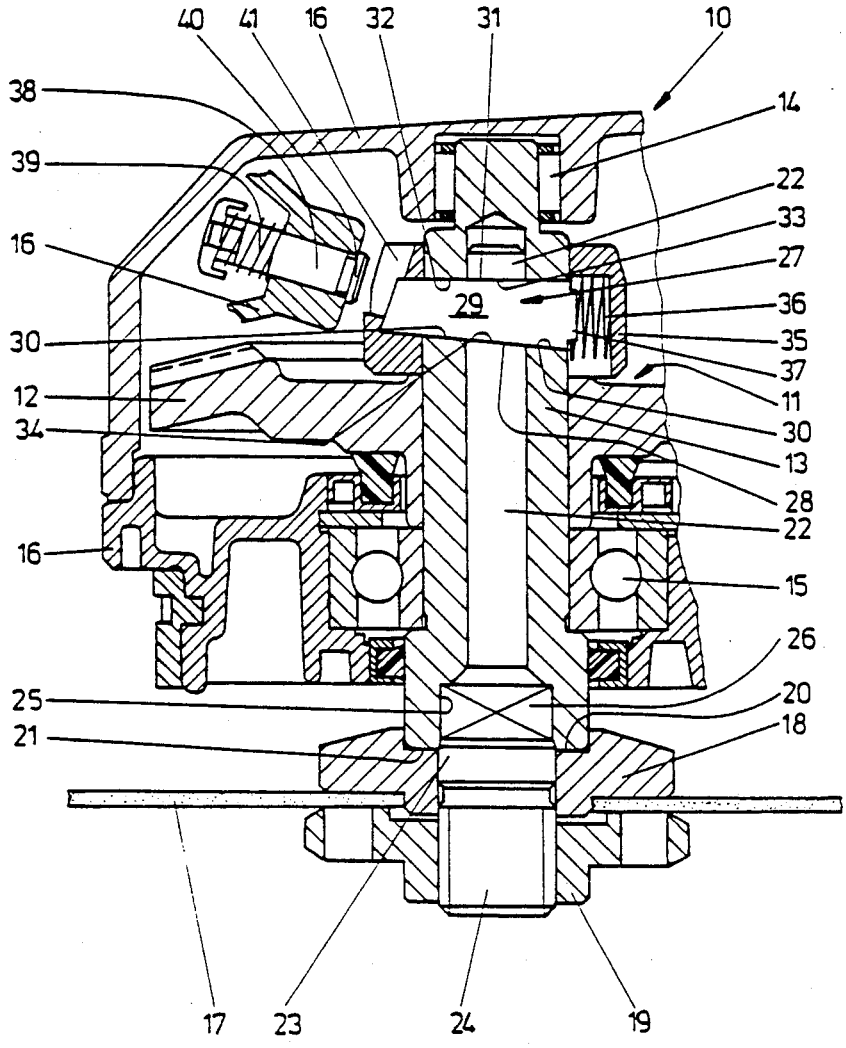
FIG. 1 shows a partial longitudinal cross-sectional view of an angle grinder with clamped grinding wheel, according to the present invention.
Figure 2:
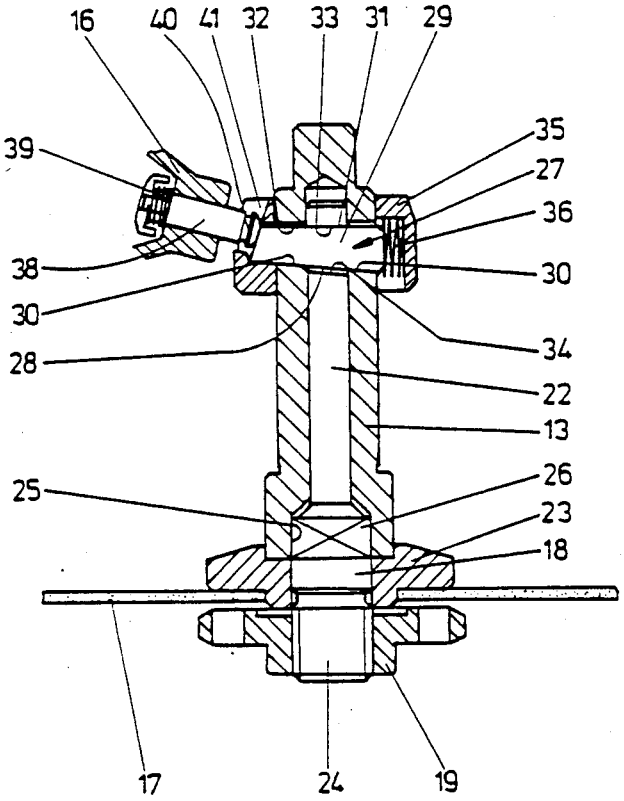
FIG. 2 shows a cross-sectional view of components of the angle grinder shown in FIG. 1 in the unclamped state for exchanging the grinding wheel.

A portable hand machine tool constructed as an angle grinder 10 is shown in FIGS. 1 and 2 and contains a motor, not shown, which drives an internally hollow drive shaft 13 through an angle drive 11, on which a bevel drive 12 is visible. The bevel gear 12 is mounted on the drive shaft 13. For joint rotation therewith the latter is rotatably supported in the housing 16 by a needle bearing 14 at the upper end and of a ball bearing 15 in the lower end region.

The drive shaft 13 serves to drive a tool 17, which consists of the indicated grinding wheel for example, or of another tool wheel, a rubber disc or the like. The tool 17 is clamped and tensioned between a counterflange 18 and a clamp nut 19. The counterflange 18 is mounted as shown in FIGS. 1 and 2, on the lower end of the drive shaft 13 upon which it is centred. The counterflange 18 has an axial surface 20, against the facing end surface 21 of the drive shaft 13.

A spindle 22 is located within the drive shaft 13 extends through the drive shaft 13 along its total length starting from the region of the needle bearing 14, and has a cylindrical shoulder that extends into the counterflange 18. The cylindrical shoulder 23 has a relative mobility and an end threaded section 24 adjacent to the latter, for receiving thereonto the clamp nut 19.

The spindle 22 is coupled to the drive shaft 13 to transmit torque. This is done by positive engagement. The drive shaft 13 contains at its lower end region inner shaped surfaces 25, two sided surfaces or multi-sided surfaces for example. In corresponding manner, the spindle 22 has outer shaped surfaces 26, two or multi-sided surfaces, for example, in the axial region associated with the shaped surfaces 25. The shaped surfaces 25 and 26 are mutually in mesh to transmit a torque. The arrangement is made so that the spindle 22 together with the screwed-on clamp nut 19 is slidable axially at least within limits relative to the hollow drive shaft 13, the torque-transmitting coupling being maintained.

A slide element 27 is also arranged in the housing 16 and is provided with an inclined surface 28 and can be slid transversely to the longitudinal central axis of the spindle 22 to effect an axial sliding of the spindle 22 together with the screwed-on clamp nut 19 relative to the drive shaft 13 and thus to achieve an axial slackening by at least slight lifting of the clamp nut 19. The slide element 27 is formed by a wedge 29 which is coupled to the drive shaft 13 and to the spindle 22 and rotates with both when the motor is switched on. The wedge 29 penetrates the drive shaft 13 and the spindle 22 transversely. In doing so it likewise constitutes a torque-transmitting element between the two, so that it is not strictly necessary to maintain the shaped surfaces 25 and 26 in mesh. The inclined surface 28 of the wedge 29 is located on the side which faces the counterflange 18. The wedge 29 is mounted by this inclined surface 28 upon a corresponding wedge surface 30 of the drive shaft 13, which extends on both sides of the wedge 29. The wedge 29 is slidable, at least in limits, on said wedge surface 30. The slope angle of the inclined surface 28 and of the wedge surface 30 is dimensioned so that self-locking occurs between them.

The wedge 29 has, on its other side opposite the inclined surface 28 and remote from the counter flange 18 a straight surface 31 which extends within a diametral plane transverse to the drive shaft 13 and spindle 22. The drive shaft 22 contains, to receive and guide the wedge 29, a transversely oriented aperture which is delimited downwards in FIGS. 1 and 2 by the wedge surface 30 and is delimited on the opposite side, at the height of the straight surface 31 of the wedge 29, by an upper linear surface 32 extending in a diametral plane.

The spindle 22 is provided with a transverse passage penetrated by the wedge 29, having an upper linear surface 33 oriented within a diametral plane and a lower wedge surface 34.

In the region of the wedge 29, the drive shaft 13 carries, fixed on it, an outer ring 35. The wedge 29 is retained and guided in the ring 35 by at least one end projecting beyond the drive shaft 13 in the transverse direction. A spring 36 constructed as a compression spring is retained within the ring 35, is centered on an end shoulder 37 of the wedge 29 and engages the wedge 29 there. The spring 36 exerts a force on the wedge 29 in the rising direction of the inclined surface 24 and wedge surfaces 30, 34 and has a tendency to push the wedge 29 from right to left in FIGS. 1 and 2.

A catch bolt 38 accessible and depressible from the outside is retained slidably in the housing 16 in the axial region of the ring 35, and can engage positively with its free end 40 at least one recess 41 on the outer ring 35 counter to the effect of a return spring 39. The recess 41 is open towards the free end 40 of the catch bolt 38, so that the latter can enter it. In the tensioned position shown in FIG. 1, the wedge 29 projects by its smaller cross-section end into the recess 41 of the outer ring 35, so that by depressing the catch bolt 38 counter to the action of the return spring 39 the wedge 29 can be engaged by the free end 40 of the catch bolt and forced thereby to slide from left to right in FIGS. 1 and 2 upon sliding of the catch bolt 38. The wedge 29 then moves downwards with its inclined surface 28 on the wedge surfaces 30 and 34 counter to the action of the spring 36.

If a new tool 17 which has been fitted is required to be fastened, this is done by tightening the clamp nut 19. The catch bolt 38 is then out of engagement with the wedge 29 and occupies the position shown in FIG. 1. The wedge 29 is then slid, due to the force of the spring 36, into the position shown in FIG. 1, which continues to be maintained due to the self-locking. The wedge 29 rests by its upper straight surface 31 against the associated linear surfaces 32 on both sides of the drive shaft 13. Through the straight surface 31, which abuts the linear surface 33 of the spindle 22, the spindle 22 is drawn axially upwards in FIGS. 1 and 2 retained by the wedge 29. The tool 17 is therefore clamped firmly between the counterflange 18 and the tightened clamp nut 19. The clamp nut 19 then presses through the tool 17 against the counterflange 18, which in turn presses with the axial surface 20 against the end face 21 of the drive shaft 13.

If it is required to exchange the tool 17, then it is only necessary for this purpose, the motor being switched off, to anchor the drive shaft 13 with spindle 22 by the depressed catch bolt 38 (FIG. 2). The depressed catch bolt 38 then engages by its free end 40 into the recess 41 of the ring 35 and thus effects locking against rotation. The catch bolt 38 also presses by its free end 40 against the smaller cross-section end of the wedge 29, which is thereby slid out of the position according to FIG. 1 to the right into the position according to FIG. 2. During this sliding the wedge 2g moves downwards with its inclined surface 28 on the wedge surface 34 of the drive shaft 13, whereby the clearance visible in FIG. 2 is created between the upper linear surface 32 and the straight surface 31 of the wedge 29. This clearance indicates that a corresponding axial sliding of the spindle 22 downwards in FIG. 2 relative to the drive shaft 13 has occurred. The sliding of the wedge 29 to the right in FIG. 2 counter to the action of the spring 36 therefore releases the spindle 22 at least slightly. Due to the axial unclamping and release of the spindle 22, the latter slides slightly downwards, together with the screwed-on clamp nut 19, which therefore lifts from the tool 17, as is likewise indicated in FIG. 2 by a slight clearance between them. The clamp nut 19 is therefore slackened solely by axial sliding of the spindle 22. It can now be unscrewed fully by hand.

The device described for fastening the tool 17 permits an exchange of the tool 17 without any additional tools.

The tool exchange is therefore considerably simplified. It can be performed rapidly and reliably. It is further advantageous that, in spite of everything, the clamping flange 18 can be shaped conventionally and can therefore be adopted. The clamp nut 19 also conforms to the standard and can be adopted unchanged in its previous construction without special adaptations. If desired, the counterflange 18 may also be integral constituent of the drive shaft 13 and therefore form a non-rotatable positive engagement with the latter, so that any possible relevant regulations may also be met. A spindle locking means present in the housing 16, in the form of the catch bolt 38 explained, which is alredy present indifferently constructed known angle grinders, is retained and put to a multiple use, namely additionally to slide the wedge 29. Because the clamp nut 19 is unmodified and therefore remains as standard, that is to say still contains the stud holes in the flange and therefore also permits the engagement of a special tool, in the form of a two-hole nut wrench for example, here again it is possible in particularly obstinate cases, of a rusted-on clamp nut 19 for example, to apply said spanner in customary manner and to slacken the clamp nut 19 with it.

While the invention has been illustrated and described as embodied in an angle grinder, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A portable hand machine tool, particularly, an angle grinder, comprising a hollow drive shaft having opposite ends; a counterflange mounted on one of said opposite ends of said hollow drive shaft for joint rotation therewith; a spindle having a longitudinal central axis and extending through said hollow drive shaft and coupled thereto for joint rotation therewith and axial displacement relative thereto, said spindle extending through said counterflange and having a threaded end portion; a clamp nut received on said threaded end portion of said spindle and cooperating with the said counterflange for clamping a tool therebetween; a slide member having an inclined surface and slidable in a direction transverse to the longitudinal central axis of said spindle to provide for axial displacement of said spindle relative to said drive shaft and for axial slackening of said clamp nut, said slide member being formed as a wedge coupled to said drive shaft and said spindle for joint rotation therewith and extending transverse through said drive shaft and said spindle, said drive shaft having a wedge surface, said inclined surface of said slide member being located on a side thereof facing the counter flange and said inclined surface abutting said wedge surface of said drive shaft and being displaceable therealong, said inclined surface of said wedge and said wedge surface of said drive shaft having an inclination angle such that self-locking of said wedge and said drive shaft occurs; and means spaced from said drive shaft and said spindle for displacing said wedge.

2. A portable hand machine tool according to claim 1 further comprising a motor and drive means for transmitting a torque from said motor to said drive shaft.

3. A portable hand machine tool according to claim 2, wherein said wedge has a straight surface extending substantially perpendicular to said drive shaft and said spindle on a side of said wedge which is opposite said inclined surface and which faces away from said counterflange.

4. A portable hand machine tool according to claim 3, wherein said spindle has a transverse passage with an upper diametrically extending linear surface extending substantially parallel to said straight surface of said wedge.

5. A portable hand machine tool according to claim 2 wherein said drive shaft has a transversely extending aperture having an upper diametrally extending linear surface abutting said straight surface of said wedge in a tensioned state.

6. A portable hand machine tool according to claim 2, wherein said displacing means includes a spring for biasing said wedge in a rising direction of said inclined surface of said wedge.

7. A portable hand machine tool according to claim 6, wherein said spring is a compression spring.

8. A portable hand machine tool according to claim 7, wherein said drive shaft includes an outer ring in which said wedge is retained, said wedge having at least one end projecting beyond said drive shaft and guided within said outer ring.

9. A portable hand machine tool according to claim 8, wherein said compression spring is retained within said outer ring and engages a larger cross-sectional end of said wedge.

10. A portable hand machine tool according to claim 9, further comprising a housing, said displacing means comprising a catch bolt retained in said housing in an axial region of said drive shaft and said spindle which contains said wedge and depressible from outside counter to the force of said spring, said catch bolt having a free end for engaging said wedge, said outer ring having a recess into which said free end of said catch bolt is extendable.

11. A portable hand machine tool according to claim 10, wherein said wedge has a smaller cross-section end projectable into said recess in said outer ring and is slidable with said inclined surface thereof down the wedge surface of said drive shaft counter to the force of said compression spring.

12. A portable hand machine tool according to claim 1, wherein said drive shaft has an inner shaped surface, and said spindle has corresponding outer shaped surfaces in an axial region associated with said inner shaped surface of said drive shaft and which positively mesh with said inner shaped surface to transmit torque to said spindle.

13. A portable hand machine tool according to claim 12, wherein said inner and outer shaped surfaces comprises one of two-sided surfaces and multi-sided surfaces.

* * * * *